United States Patent [19]

Reynolds

[11] 4,020,747

[45] May 3, 1977

[54] HYDRAULICALLY-OPERATED DEVICES

[75] Inventor: Lionel Arthur Reynolds, Stroud, England

[73] Assignee: A. F. Hydraulics Limited, Gloucester, England

[22] Filed: Nov. 27, 1974

[21] Appl. No.: 527,769

[30] Foreign Application Priority Data

Dec. 1, 1973 United Kingdom ..... 55794/73

[52] U.S. Cl. ..... 91/298; 91/300; 91/319; 91/321; 92/85 B; 92/86

[51] Int. Cl.[2] ..... F01L 25/06; F01B 7/18; F01B 11/02

[58] Field of Search ..... 92/143, 85 B; 91/300, 91/321, 298, 319

[56] References Cited

UNITED STATES PATENTS

| | | | |
|---|---|---|---|
| 1,262,170 | 2/1972 | Westinghouse | 92/85 B |
| 3,303,756 | 2/1967 | Geeson | 92/143 |
| 3,596,562 | 8/1971 | Foster | 92/85 B |
| 3,636,707 | 1/1972 | Saari | 92/143 |
| 3,800,662 | 4/1974 | Ackley | 92/143 |
| 3,887,019 | 6/1975 | Reynolds et al. | 92/85 B |

*Primary Examiner*—Paul E. Maslousky
*Attorney, Agent, or Firm*—Cushman, Darby & Cushman

[57] ABSTRACT

A hydraulically-operated reciprocatory device such as a road-breaking hammer includes piston means having an enlarged area portion which enters an overtravel-damping dashpot cavity. The dashpot cavity is in a chamber connected in series with valve means controlling the flow of hydraulic fluid such that said fluid flow through the chamber removes heat generated during a damping action.

11 Claims, 2 Drawing Figures

HYDRAULICALLY-OPERATED DEVICES

FIELD OF THE INVENTION

This invention relates to hydraulically-operated devices having piston means reciprocable hydraulically to execute working strokes in at least one direction. It is particularly, but not exclusively, concerned with hydraulically-operated percussive implements having piston and striker means, with the striker means imparting at the end of each power stroke an impulsive blow which is transmitted to a tool in use mounted in or on a casing of the implement.

BACKGROUND OF THE INVENTION

With such an implement the impulsive blows imparted by the striker means necessarily involve high velocities of the piston and striker means in order to perform the required work. It is thus necessary to provide means to absorb the energy of the piston and striker means in the event of overtravel on the power stroke, for example when the tool breaks through the work or (when the implement is a portable hammer) the operator "lifts off" the implement from the work, to prevent shock damage to the casing and/or other parts. It has accordingly been proposed to provide an enlarged diameter portion for the piston and striker means which, on overtravel, enters a fluid-filled dashpot cavity to provide a snubbing action which damps the excessive overtravel of the piston means as the escape of fluid from the cavity as the enlarged portion enters the cavity is restricted. The invention has for its object to provide an implement with effective means for removing heat generated as a result of the damping action.

SUMMARY OF THE INVENTION

According to the invention a hydraulically-operated device has hydraulically-actuated piston means provided or associated with an enlarged area portion which enters a dashpot cavity to damp overtravel at the end of a working stroke of the piston means, the dashpot cavity being provided in a chamber which is in use filled with hydraulic fluid and connected in series with valve means controlling the flow of fluid to actuate the piston means, so that a flow of pressure fluid through the chamber removes the heat generated therein as a result of the dashpot damping action.

Said chamber is preferably connected in series with the valve means on the pressure inlet side of the latter. When the device is a percussive implement the piston means are associated with the striker means, and the enlarged area damping portion which enters the dashpot cavity may be provided on the piston means or the striker means, although both these means may be provided by a one-piece piston/striker member.

The enlarged area portion may be provided by a collar or an enlarged head on a piston member of the piston means, and the fluid pressure in said chamber may act on an effective area of that piston member to produce return or "recuperation" strokes of the piston means. As in this case the piston means are permanently biassed in the return direction, due to the operating fluid pressure in the combined damping and recuperation chamber, the piston means require an effective working area—acted on by fluid pressure under the control of the valve—which is substantially greater than the recuperation area. Both these areas are, of course, kept as small as practicable consistent with the operational and power requirements to reduce the high pressure hydraulic flow to provide a compact and efficient arrangement. The foregoing assumes an "idle" return stroke, but it will be appreciated that a device in accordance with the invention may execute working strokes in both directions.

The restricted escape passage of fluid from the dashpot cavity during overtravel of the piston and striker means may be provided solely by radial clearance of said enlarged area portion within the dashpot cavity. Alternatively one or more specific restricted escape passages may be provided for the dashpot cavity, and an enlarged inlet passage may be provided controlled by a check valve to prevent reverse damping immediately the piston and striker means commence a recuperation stroke.

In a preferred embodiment, for maximum efficiency, the piston and striker means are provided by a single integral piston/striker member. This has a piston portion providing the effective working and return areas as well as a collar or head providing the damping area, and a striker portion which impacts the tool directly. However it will be appreciated that the piston and striker means can be split into a number of interengaging component members; for example, the effective return and damping areas may be on one piston member and the effective working area on a separate actuating piston member. If desired an intermediate "anvil" may be provided through which the working impulses are transmitted from the striker means to the tool.

DESCRIPTION OF THE PREFERRED EMBODIMENT

Figure 1:
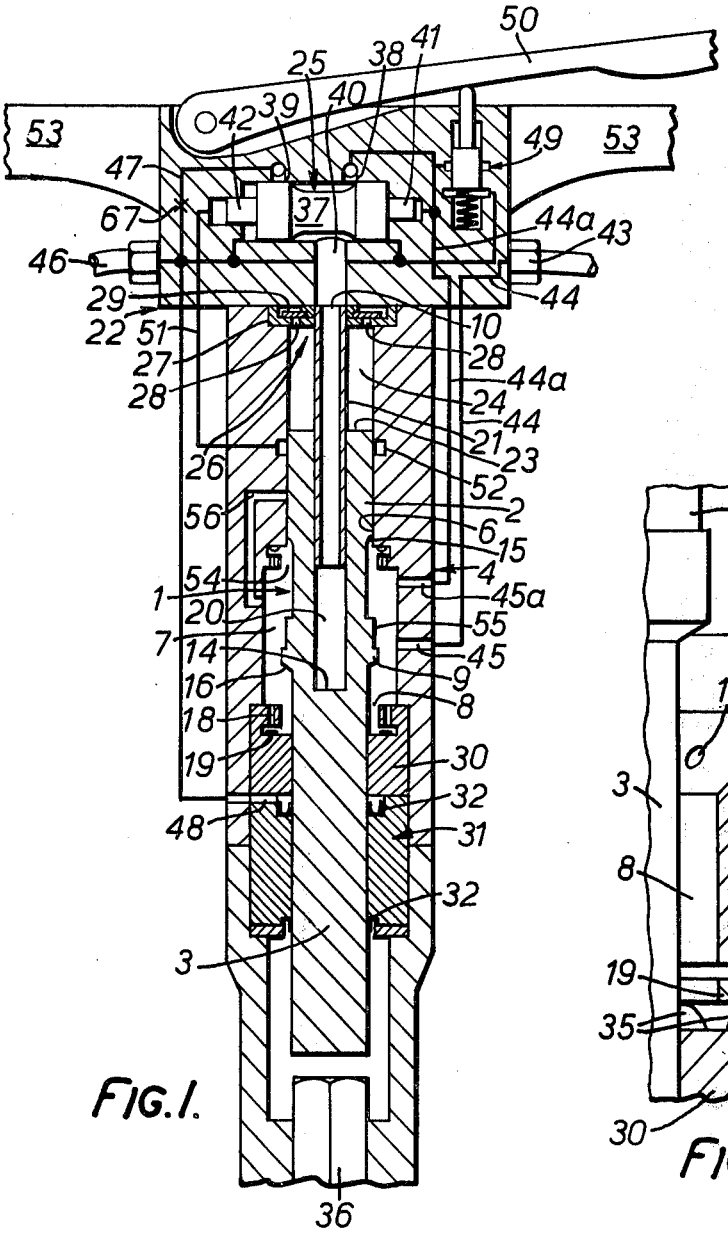
FIG. 1 is a longitudinal axial sectional veiw of the hammer.
Figure 2:
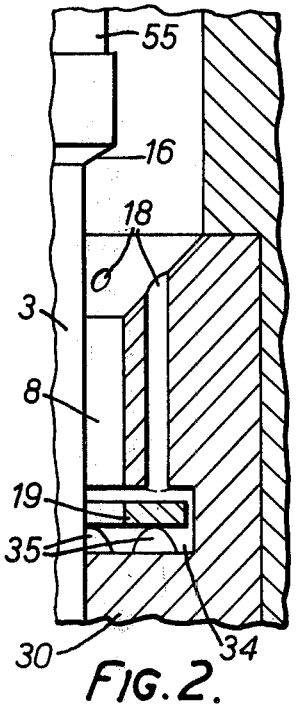
FIG. 2 is an enlarged detail view of a portion of FIG. 1.

An integral striker/piston member 1 is reciprocable in a casing 4, which has a bore 6 in which a piston head 2 of the member 1 is a sliding fit. The casing has a chamber 7 with a dashpot cavity 8 of reduced diameter at its lower end, i.e. the end adjacent the tool-receiving end of the hammer. A lower striker portion 3 of the striker/piston member 1 directly impacts a tool 36 during operation of the hammer. An enlarged area portion of the member 2 which enters the cavity 8 to damp overtravel of that member is provided by an integral annular collar 9 presenting an effective damping area 16.

The piston head 2 is bored out at 20 to receive a tube 21 anchored to the upper end of the casing 4 and held in position by a casing head 22. The lower end wall 14 of the bore 20 constitutes the effective piston working area. The upper annular end face 23 of the piston head 2 may be regarded as an idle annulus so far as the execution of working and return piston strokes is concerned. It is nevertheless harnessed to a useful function, in connection with the operation of a valve 25, to be described later.

At the top of the chamber 24 surrounding the tube 21 there is a one-way valve 26 comprising a shallow cup 27 having holes 28 spaced around it, these holes being normally obscured by an annular spring washer 29 held in place by its inner margin being trapped between the cup 27 and an end flange on the tube 21. The whole assembly is held in position by the casing head 22.

The chamber 24 tends to receive a small amount of leakage fluid from the chamber 7 past the piston head 2, and from the bore 20 past the tube 21. This is expelled through the one-way valve 26 when the annular piston face 23 rises during the return piston strokes. When the striker/piston member 1 descends the valve 26 closes and a partial vacuum is formed in the chamber 24.

A number of axial bores 18 lead from the chamber 7 to a recess 34 undercut outwardly from the base of the dashpot cavity 8. An annular ring 19 normally rests clear of the lower ends of the bores 18, upon a seies of pimples 35 spaced around the lower surface of the undercut recess. When the collar 9 passes into the dashpot cavity 8, it initially displaces fluid upwardly through the bores 18 but the flow draws the annular ring 19 upwards due to the Bernoulli effect. Thereafter the ring 19 seals off the bores 18 and the fluid can only be displaced past the radial clearance of the collar 9 within the dashpot cavity 8.

When the striker/piston member 1 comes to rest after the collar 9 has entered the dashpot cavity 8, the ring 19 falls away from the bores 18 permitting fluid to flow from the chamber into the cavity 8 so that the pressures on both sides of the collar 9 equalise and the piston return stroke is thus not damped.

The valve 25 and its mode of operation will now be described. A two-land spool 37 is slidable in a bore having two side ports 38 and 39 and a central port 40 leading to the bore 20, which provides the working chamber, through the tube 21. The end of the spool 37 nearest to the port 38 has a pilot piston 41 and the other end of the spool 37 has a larger diameter pilot piston portion 42.

A high pressure fluid inlet connection 43 is connected via a conduit 44 to a port 45 leading to the chamber 7. The high pressure fluid flow leaves the chamber 7 through a port 45*a* and through a conduit 44*a* which is connected to the valve port 38 and the pilot piston 41. The flow through the chamber 7 removes the heat generated during the overtravel damping action.

A low pressure fluid exhaust connection 46 is connected, via a conduit 47, to the port 39 and to a leakage recovery port 48 associated with sealing means 31 for the chamber 7 and through which the striker portion 3 passes. The means 31 include a member 30 in which the cavity 8 is formed and spaced lipped seals 32.

The conduits 44*a* and 47 are connected to a stop-start valve 49 operated by a hand lever 50 pivoted on the casing head 22. When the implement is operating the high pressure fluid bears constantly upon the end face of the pilot piston 41.

The larger diameter pilot piston 42 is connected via a conduit 51 to a port 52 in the wall of the bore 6 at a position such that it is cleared by the end face 23 of the piston head 2 when the latter approaches the lower end of its stroke. This places the pilot piston 42 in communication with the chamber 24 which is then at low pressure so that the spool 37 moves to the left, driven by the high pressure acting on the pilot piston 41, to put the chamber 20 into communication with the low pressure connection 46. In this condition the neck of spool 37 bridges the ports 39 and 40, with the port 38 closed off. The striker/piston member 1 then rises because of the pressure in the chamber 7 acting on the effective return piston area.

An upper dashpot is provided to enable the oscillation frequency of the hammer to be controlled. Above the collar 9 the diameter of the striker/piston member 1 is enlarged, at 55, for a short distance, to the same diameter as that of the bore 6. An upper dashpot cavity 54 is provided at the top of chamber 7, and this is entered by the collar 9 towards the end of the recuperation stroke.

The port 52 is exposed to the high pressure in the chamber 7 when the member 1 reaches (or closely approaches) the upper end of the return stroke and an annular lower edge 15 of the piston head 2 reaches the port 52. This edge 15 may be said to delimit the return piston area but its annular area is not necessarily equal to that area since the member 1 is preferably necked in immediately below the edge 15 to improve fluid flow conditions. The actual dimensions of the effective return piston area are determined by the difference between the cross-sectional areas of the piston head 2 and the striker portion 3.

The enlargement 55 enters the bore 6 to seal off the dashpot cavity 54 before the edge 15 reaches the port 52, and a by-pass passage 56 is provided to ensure that fluid from the chamber 7 can reach the port 52 when the edge 15 reaches it. The enlargement 55 prevents the escape of fluid, trapped in the dashpot cavity 54 when entered by the collar 9, from escaping via the passage 56 when the port 52 has been uncovered by edge 15. It will be appreciated that heat resulting from this damping action is also removed by the high pressure flow through the chamber 7.

The dashpot cavity 54 and the collar 9 are proportioned to limit the oscillation frequency to an acceptable maximum. The upper dashpot 54 may not be necessary, and instead a restrictor in the exhaust passage from the chamber 20 may be employed to regulate the impacting rate of the hammer. Such a restrictor would preferably be inserted in the conduit 47 and is diagrammatically indicated by X and referenced 67 in the drawings.

Towards the end of an upward recuperation stroke of the striker/piston member 1, the edge 15 of the piston head 2 passes the port 52 to expose the latter, via the passage 56, to the high pressure within the chamber 7 so that the force acting on the pilot piston 42, by reason of the larger diameter thereof, overrides the force acting on the pilot piston 41, so that the spool 37 is driven to the right. This closes off the port 39 and bridges the ports 38 and 40 to apply the pressure from connection 43 to the chamber 20. Since the piston working area 14 is substantially larger than the return piston area, the member 1 is now forced downwards upon tool 36 to execute a working stroke. As soon as the edge 15 of piston head 2 has passed over the port 52 the pilot piston 42 is isolated and the valve means hydraulically locked with the spool 37 held over to the right until the piston face 23 uncovers the port 52, enabling the cavity containing the pilot piston 42 to discharge into the chamber 24 which is at this time below atmospheric pressure. The spool 37 then again moves to the left.

The fluid displaced by the pilot piston 42 into the chamber 24 is discharged with other fluid leaking into that chamber, to the low pressure connection 46 via the valve 26 and the conduit 47, on the up-stroke of the striker/piston member 1.

A hydraulic accumulator may be connected to the high pressure fluid connection 43 to maintain a substantially steady operating pressure. It operates by storing energy during the recuperation strokes which makes for improved efficiency and also reduces pressure surges in the supply pipe.

The spool of the on-off valve 49 is spring loaded upwardly to a position in which it uncovers a port connected to the conduit 44*a* and places it in communication with another port connected to the conduit 47, so that the high pressure fluid is short-circuited to the low pressure connection 46. The implement is thus disabled, and a short-circuited cooling flow passes through the damping chamber 7.

The movable handle 50 rests above one of the main handles 53 of the hammer and is automatically lowered on grasping that main handle, to force the spool of the on-off valve 49 downwards to the position shown in the drawings. In this position the port connected to the high pressure connection 43 is closed off.

What is claimed is:

1. A hydraulically operated reciprocatory device comprising:

a body, reciprocatory piston means within said body, said piston means having an enlarged area portion and said body containing a chamber with a dashpot cavity entered by said enlarged area portion of said piston, said chamber having inlet and outlet ports with said inlet port being adapted to be connected to a source of hydraulic fluid under a continuous, unidirectional pressure to damp overtravel of the piston means at the end of a working stroke thereof and to drive said piston in a return stroke, and valve means connected to said outlet port of said chamber for receiving said hydraulic fluid under said continuous unidirectional pressure, said valve means controlling the flow of said hydraulic fluid to drive the piston means in said working stroke and controlling the exhaust of said hydraulic fluid from said device, wherein during operation of the device, said hydraulic fluid flows continually from said inlet port, through said chamber, through said outlet port and through said valve means to thereby remove heat generated as the result of the dashpot action in said dashpot cavity.

2. A device according to claim 1, wherein a second dashpot cavity in said chamber damps overtravel at the end of a return stroke of the piston means.

3. A device according to claim 1, wherein the fluid pressure in said chamber acts on the piston means to actuate the piston means in one direction.

4. A device according to claim 3, wherein the fluid pressure in said chamber actuates return strokes of the piston means.

5. A device according to claim 1, wherein said enlarged area porton is provided by a collar on the piston means, which collar is movable in said chamber with all-round clearance and when not in the corresponding dashpot cavity presents to the fluid pressure in said chamber an effective area which is small compared to the area presented by said enlarged area portion of said piston means to said fluid in said dashpot cavity, said area presented by said enlarged area portion in said dashpot cavity being the effective damping area.

6. A device according to claim 1, wherein restricted escape of fluid from the dashpot cavity during overtravel of the piston means is provided solely by radial clearance of said enlarged area portion within the dashpot cavity.

7. A device according to claim 6, wherein an enlarged inlet passage is provided for the dashpot cavity, which passage is controlled by a check valve to prevent reverse damping immediately after the piston and striker means commence a return stroke.

8. A device according to claim 1, wherein at least one specific restricted escape passage is provided for the dashpot cavity.

9. A device according to claim 1, wherein the device is a percussive implement, said body providing a mounting for a tool and the piston means being associated with striker means to impart, at the end of each ower stroke, and impulsive blow which is transmitted to said tool in the body.

10. A device according to claim 9, wherein the piston and striker means are provided by a single integral piston/striker member

11. A device according to claim 1 wherein said chamber is connected between said valve means and said pressure source, whereby hydraulic fluid enters the device through said chamber and then into said valve means.

* * * * *